US010109286B2

(12) United States Patent
Tachibana et al.

(10) Patent No.: US 10,109,286 B2
(45) Date of Patent: Oct. 23, 2018

(54) SPEECH SYNTHESIZER, AUDIO WATERMARKING INFORMATION DETECTION APPARATUS, SPEECH SYNTHESIZING METHOD, AUDIO WATERMARKING INFORMATION DETECTION METHOD, AND COMPUTER PROGRAM PRODUCT

(71) Applicant: KABUSHIKI KAISHA TOSHIBA, Tokyo (JP)

(72) Inventors: Kentaro Tachibana, Kanagawa (JP); Takehiko Kagoshima, Kanagawa (JP); Masatsune Tamura, Kanagawa (JP); Masahiro Morita, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 15/704,051

(22) Filed: Sep. 14, 2017

(65) Prior Publication Data

US 2018/0005637 A1 Jan. 4, 2018

Related U.S. Application Data

(60) Division of application No. 14/801,152, filed on Jul. 16, 2015, now Pat. No. 9,870,779, which is a (Continued)

(51) Int. Cl.
*G10L 21/00* (2013.01)
*G10L 19/018* (2013.01)
(Continued)

(52) U.S. Cl.
CPC ..... *G10L 19/018* (2013.01); *G10L 13/02* (2013.01); *G10L 13/033* (2013.01); *G10L 19/012* (2013.01)

(58) Field of Classification Search
CPC ..... G10L 19/02; G10L 19/018; G10L 25/90; G10L 17/22; G10L 17/005; H04M 9/082;
(Continued)

(56) References Cited

U.S. PATENT DOCUMENTS 5,596,676 A 1/1997 Swaminathan et al.
5,734,789 A 3/1998 Swaminathan et al.
(Continued)

FOREIGN PATENT DOCUMENTS

JP 2003-295878 A 10/2003
JP 2006-251676 A 9/2006
(Continued)

OTHER PUBLICATIONS

Chinese Patent Office Notification to Make Rectifications Action dated Aug. 3, 2015 as received in corresponding Chinese Application No. 201380070775.X and its English translation (2 pages).
(Continued)

*Primary Examiner* — Vijay B Chawan
(74) *Attorney, Agent, or Firm* — Foley & Lardner, LLP

(57) ABSTRACT

According to an embodiment, a speech synthesizer includes a source generator, a phase modulator, and a vocal tract filter unit. The source generator generates a source signal by using a fundamental frequency sequence and a pulse signal. The phase modulator modulates, with respect to the source signal generated by the source generator, a phase of the pulse signal at each pitch mark based on audio watermarking information. The vocal tract filter unit generates a speech signal by using a spectrum parameter sequence with respect to the source signal in which the phase of the pulse signal is modulated by the phase modulator.

5 Claims, 12 Drawing Sheets

Related U.S. Application Data continuation of application No. PCT/JP2013/050990, filed on Jan. 18, 2013.

(51) Int. Cl.

| | |
|---|---|
| ***G10L 13/033*** | (2013.01) |
| ***G10L 13/02*** | (2013.01) |
| *G10L 19/012* | (2013.01) |

(58) Field of Classification Search

CPC ..... G11B 27/034; G11B 27/34; G06F 21/32; G07C 9/00158; G07C 9/00166

USPC ..... 704/207, 278, 200.1, 208, 206, 270, 273

See application file for complete search history.

(56) References Cited

U.S. PATENT DOCUMENTS

| | | | | |
|---|---|---|---|---|
| 6,067,511 | A | 5/2000 | Grabb et al. | |
| 6,480,825 | B1 | 11/2002 | Sharma et al. | |
| 7,461,002 | B2 * | 12/2008 | Crockett | G11B 27/034 704/278 |
| 7,555,432 | B1 | 6/2009 | Gopalan | |
| 8,527,268 | B2 | 9/2013 | Quan | |
| 8,898,062 | B2 | 11/2014 | Kato et al. | |
| 9,058,807 | B2 | 6/2015 | Tamura et al. | |
| 2006/0227968 | A1 * | 10/2006 | Chen | G10L 19/018 380/205 |
| 2006/0229878 | A1 | 10/2006 | Scheirer | |
| 2007/0217626 | A1 | 9/2007 | Sharma et al. | |
| 2009/0204395 | A1 | 8/2009 | Kato et al. | |
| 2010/0042406 | A1 * | 2/2010 | Johnston | G10L 19/02 704/200.1 |
| 2011/0166861 | A1 | 7/2011 | Wang et al. | |
| 2012/0213380 | A1 * | 8/2012 | Mahe | H04M 9/082 381/71.11 |
| 2013/0254159 | A1 | 9/2013 | Thramann et al. | |
| 2014/0297271 | A1 * | 10/2014 | Geiser | G10L 19/02 704/207 |

FOREIGN PATENT DOCUMENTS

| | | | |
|---|---|---|---|
| JP | 2009-210828 | A | 9/2009 |
| JP | 4357791 | B2 | 11/2009 |
| JP | 2010-169766 | A | 8/2010 |
| JP | 5085700 | B2 | 11/2012 |
| JP | 5422754 | B2 | 2/2014 |

OTHER PUBLICATIONS

U.S. Office Action dated Nov. 16, 2016 as issued in corresponding U.S. Appl. No. 14/801,152.

U.S. Office Action dated Jun. 28, 2017 as issued in corresponding U.S. Appl. No. 14/801,152.

Tachibana, et al.: U.S. Notice of Allowance on U.S. Appl. No. 14/801,152 dated Sep. 20, 2017.

* cited by examiner

FIG.6A SPEECH WAVEFORM (SOURCE OF ANALYSIS)

FIG.6B FUNDAMENTAL FREQUENCY SEQUENCE

FIG.6C PITCH MARK

FIG.6D BAND NOISE INTENSITY

SPEECH SYNTHESIZER, AUDIO WATERMARKING INFORMATION DETECTION APPARATUS, SPEECH SYNTHESIZING METHOD, AUDIO WATERMARKING INFORMATION DETECTION METHOD, AND COMPUTER PROGRAM PRODUCT

CROSS-REFERENCE TO RELATED APPLICATION(S)

This application is a divisional application of U.S. application Ser. No. 14/801,152, filed Jul. 16, 2015, which is a continuation of PCT international application Ser. No. PCT/JP2013/050990 filed on Jan. 18, 2013 which designates the United States; the entire contents of which are incorporated herein by reference.

FIELD

Embodiments described herein relate generally to a speech synthesizer, an audio watermarking information detection apparatus, a speech synthesizing method, an audio watermarking information detection method, and a computer program product.

BACKGROUND

It is widely known that a speech is synthesized by performing filtering, which indicates a vocal tract characteristic, with respect to a sound source signal indicating a vibration of a vocal cord. Further, quality of a synthesized speech is improved and may be used inappropriately. Thus, it is considered that it is possible to prevent or control inappropriate use by inserting watermark information into a synthesized speech.

However, when an audio watermarking is embedded into a synthesized speech, there is a case where sound quality is deteriorated.

DETAILED DESCRIPTION

According to an embodiment, a speech synthesizer includes a sound source generator, a phase modulator, and a vocal tract filter unit. The sound source generator generates a sound source signal by using a fundamental frequency sequence and a pulse signal. The phase modulator modulates, with respect to the sound source signal generated by the sound source generator, a phase of the pulse signal at each pitch mark based on audio watermarking information. The vocal tract filter unit generates a speech signal by using a spectrum parameter sequence with respect to the sound source signal in which the phase of the pulse signal is modulated by the phase modulator.

Speech Synthesizer

Figure 1:
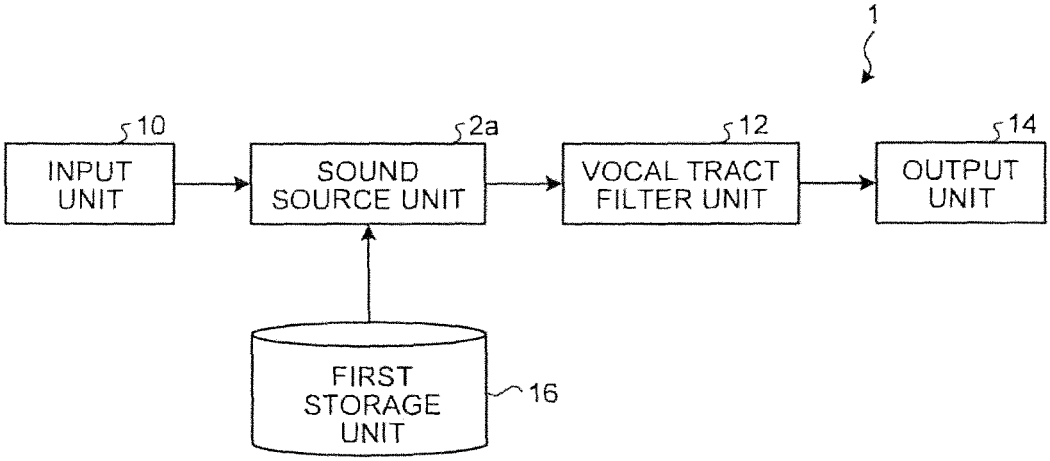
FIG. 1 is a block diagram illustrating an example of a configuration of a speech synthesizer according to an embodiment.

In the following, with reference to the attached drawings, a speech synthesizer according to an embodiment will be described. FIG. 1 is a block diagram illustrating an example of a configuration of a speech synthesizer 1 according to an embodiment. Note that the speech synthesizer 1 is realized, for example, by a general computer. That is, the speech synthesizer 1 includes, for example, a function as a computer including a CPU, a storage apparatus, an input/output apparatus, and a communication interface.

As illustrated in FIG. 1, the speech synthesizer 1 includes an input unit 10, a sound source unit 2*a*, a vocal tract filter unit 12, an output unit 14, and a first storage unit 16. Each of the input unit 10, the sound source unit 2*a*, the vocal tract filter unit 12, and the output unit 14 may include a hardware circuit or software executed by a CPU. The first storage unit 16 includes, for example, a hard disk drive (HDD) or a memory. That is, the speech synthesizer 1 may realize a function by executing a speech synthesizing program.

The input unit 10 inputs a sequence (hereinafter, referred to as fundamental frequency sequence) indicating information of a fundamental frequency or a fundamental period, a sequence of a spectrum parameter, and a sequence of a feature parameter at least including audio watermarking information into the sound source unit 2*a*.

For example, the fundamental frequency sequence is a sequence of a value of a fundamental frequency ($F_0$) in a frame of voiced sound and a value indicating a frame of unvoiced sound. Here, the frame of unvoiced sound is a sequence of a predetermined value which is fixed, for example, to zero. Further, the frame of voiced sound may include a value such as a pitch period or a logarithm $F_0$ in each frame of a period signal.

In the present embodiment, a frame indicates a section of a speech signal. When the speech synthesizer 1 performs an analysis at a fixed frame rate, a feature parameter is, for example, a value in each 5 ms.

The spectrum parameter is what indicates spectral information of a speech as a parameter. When the speech synthesizer 1 performs an analysis at a fixed frame rate similarly to a fundamental frequency sequence, the spectrum parameter becomes a value corresponding, for example, to a section in each 5 ms. Further, as a spectrum parameter, various parameters such as a cepstrum, a mel-cepstrum, a linear prediction coefficient, a spectrum envelope, and mel-LSP are used.

By using the fundamental frequency sequence input from the input unit 10, a pulse signal which will be described later, or the like, the sound source unit 2*a* generates a sound source signal (described in detail with reference to FIG. 2) a phase of which is modulated and outputs the signal to the vocal tract filter unit 12.

The vocal tract filter unit 12 generates a speech signal by performing a convolution operation of the sound source signal, a phase of which is modulated by the sound source unit 2*a*, by using a spectrum parameter sequence received through the sound source unit 2*a*, for example. That is, the vocal tract filter unit 12 generates a speech waveform.

The output unit 14 outputs the speech signal generated by the vocal tract filter unit 12. For example, the output unit 14 displays a speech signal (speech waveform) as a waveform output as a speech file (such as WAVE file).

The first storage unit 16 stores a plurality of kinds of pulse signals used for speech synthesizing and outputs any of the pulse signals to the sound source unit 2*a* according to an access from the sound source unit 2*a*.

Figure 2:
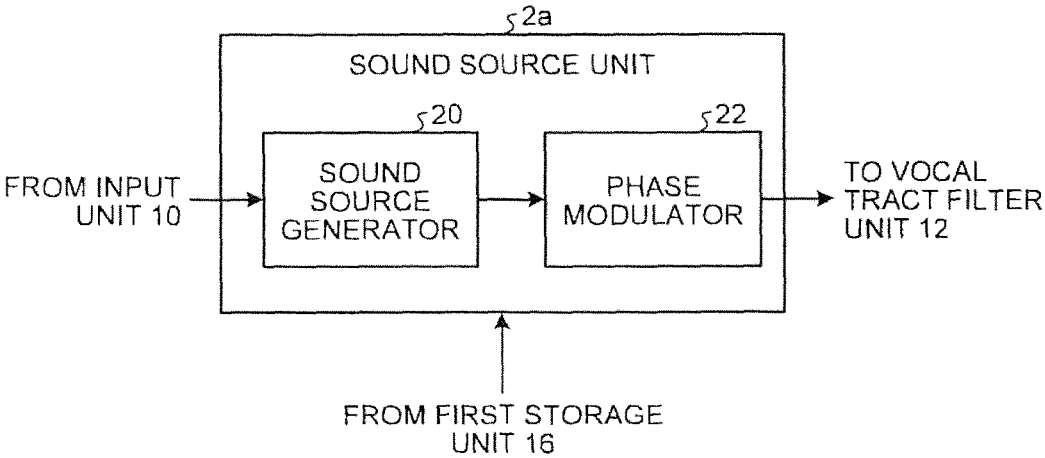
FIG. 2 is a block diagram illustrating an example of a configuration of a sound source unit.

FIG. 2 is a block diagram illustrating an example of a configuration of the sound source unit 2*a*. As illustrated in FIG. 2, the sound source unit 2*a* includes, for example, a sound source generator 20 and a phase modulator 22. The sound source generator 20 generates a (pulse) sound source signal with respect to a frame of voiced sound by deforming the pulse signal, which is received from the first storage unit 16, by using a sequence of a feature parameter received from the input unit 10. That is, the sound source generator 20 creates a pulse train (or pitch mark train). The pitch mark train is information indicating a train of time at which a pitch pulse is arranged.

For example, the sound source generator 20 determines a reference time and calculates a pitch period in the reference time from a value in a corresponding frame in the fundamental frequency sequence. Further, the sound source generator 20 creates a pitch mark by repeatedly performing, with reference to the reference time, processing of assigning a mark at time forwarded for a calculated pitch period. Further, the sound source generator 20 calculates a pitch period by calculating a reciprocal number of the fundamental frequency.

The phase modulator 22 receives the (pulse) sound source signal generated by the sound source generator 20 and performs phase modulation. For example, the phase modulator 22 performs, with respect to the sound source signal generated by the sound source generator 20, modulation of a phase of a pulse signal at each pitch mark based on a phase modulation rule in which audio watermarking information included in the feature parameter is used. That is, the phase modulator 22 modulates a phase of a pulse signal and generates a phase modulation pulse train.

The phase modulation rule may be time-sequence modulation or frequency-sequence modulation. For example, as illustrated in the following equations (1) and (2), the phase modulator 22 modulates a phase in time series in each frequency bin or performs temporal modulation by using an all-pass filter which randomly modulates at least one of a time sequence and a frequency sequence.

For example, when the phase modulator 22 modulates a phase in time series, the input unit 10 may previously input, into the phase modulator 22, a table indicating a phase modulation rule group which varies in each time sequence (each predetermined period of time) as key information used for audio watermarking information. In this case, the phase modulator 22 changes a phase modulation rule in each predetermined period of time based on the key information used for the audio watermarking information. Further, in an audio watermarking information detection apparatus (described later) to detect audio watermarking information, the phase modulator 22 can increase confidentiality of an audio watermarking by using the table used for changing the phase modulation rule.

$$ph(t, f) = \begin{cases} at(f > 0) \\ 0(f = 0) \\ -at(f < 0) \end{cases} \tag{1}$$

$$ph(t, f) = rand(f, t) \tag{2}$$

Note that a indicates phase modulation intensity (inclination), f indicates a frequency bin or band, t indicates time, ph (t, f) indicates a phase of a frequency f at time t. The phase modulation intensity a is, for example, a value changed in such a manner that a ratio or a difference between two representative phase values, which are calculated from phase values of two bands including a plurality of frequency bins, becomes a predetermined value. Then, the speech synthesizer 1 uses the phase modulation intensity a as bit information of the audio watermarking information. Further, the speech synthesizer 1 may increase the number of bits of the bit information of the audio watermarking information by setting the phase modulation intensity a (inclination) as a plurality of values. Further, in the phase modulation rule, a median value, an average value, a weighted average value, or the like of a plurality of predetermined frequency bins may be used.

Figure 3:
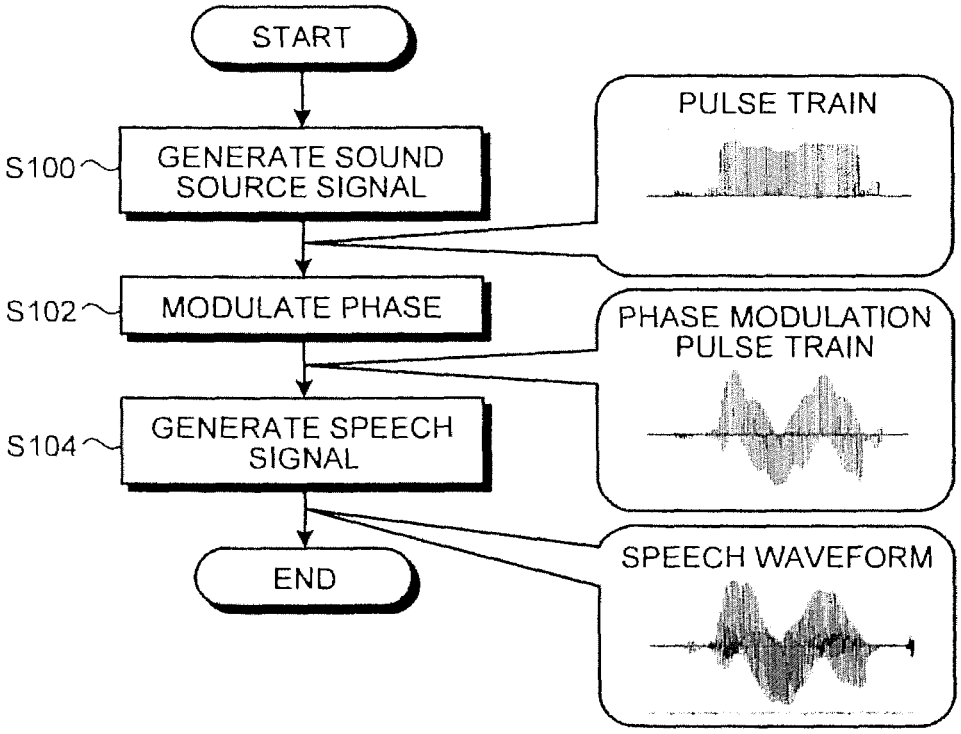
FIG. 3 is a flowchart illustrating an example of processing performed by the speech synthesizer according to the embodiment.

Next, processing performed by the speech synthesizer 1 illustrated in FIG. 1 will be described. FIG. 3 is a flowchart illustrating an example of processing performed by the speech synthesizer 1. As illustrated in FIG. 3, in step S100, the sound source generator 20 generates a (pulse) sound source signal with respect to a frame of voiced sound by performing deformation of the pulse signal, which is received from the first storage unit 16, by using a sequence of a feature parameter received from the input unit 10. That is, the sound source generator 20 outputs a pulse train.

In step S102, the phase modulator 22 performs, with respect to the sound source signal generated by the sound source generator 20, modulation of a phase of a pulse signal at each pitch mark based on a phase modulation rule using audio watermarking information included in the feature parameter. That is, the phase modulator 22 outputs a phase modulation pulse train.

In step S104, the vocal tract filter unit 12 generates a speech signal by performing a convolution operation of the sound source signal, a phase of which is modulated by the sound source unit 2*a*, by using a spectrum parameter sequence which is received through the sound source unit 2*a*. That is, the vocal tract filter unit 12 outputs a speech waveform.

Figure 4A:
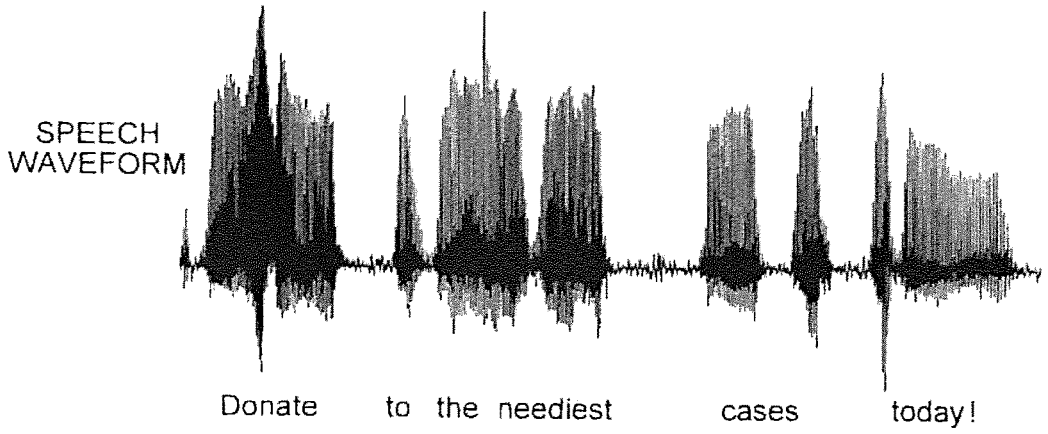
FIGS. 4A and 4B are views for comparing a speech waveform without an audio watermarking with a speech waveform to which an audio watermarking is inserted by the speech synthesizer.
Figure 4B:
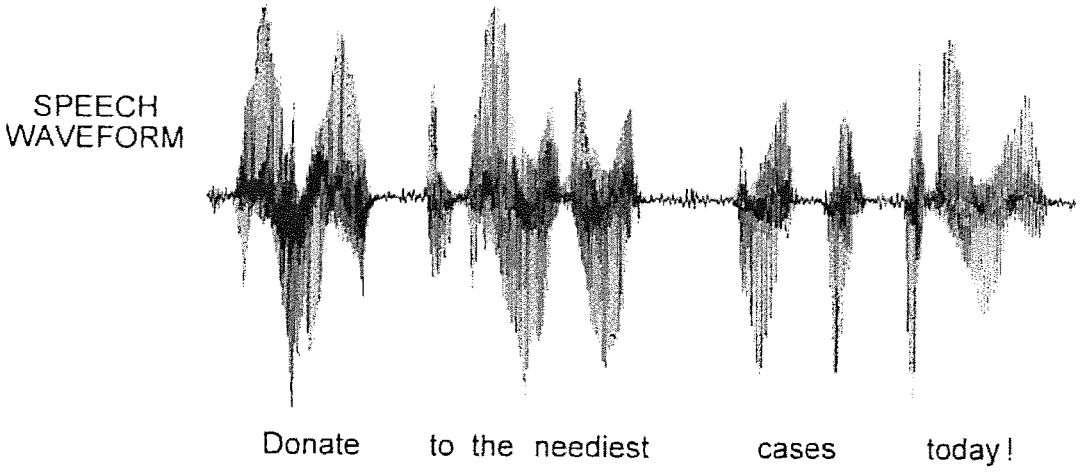

FIGS. 4A and 4B are views for comparing a speech waveform without an audio watermarking with a speech waveform to which an audio watermarking is inserted by the speech synthesizer 1. FIG. 4A is a view illustrating an example of a speech waveform of a speech "Donate to the neediest cases today!" without an audio watermarking. Further, FIG. 4B is a view illustrating an example of a speech waveform of a speech "Donate to the neediest cases today!" into which the speech synthesizer 1 inserts an audio watermarking by using the above equation 1. Compared to the speech waveform illustrated in FIG. 4A, a phase of the speech waveform illustrated in FIG. 4B is shifted (modulated) due to insertion of the audio watermarking. For example, even when the audio watermarking is inserted, sound quality deterioration with respect to a hearing sense of a person is not caused in the speech waveform illustrated in FIG. 4A.

First Modification Example of Sound Source Unit 2*a*: Sound Source Unit 2*b*

Figure 5:
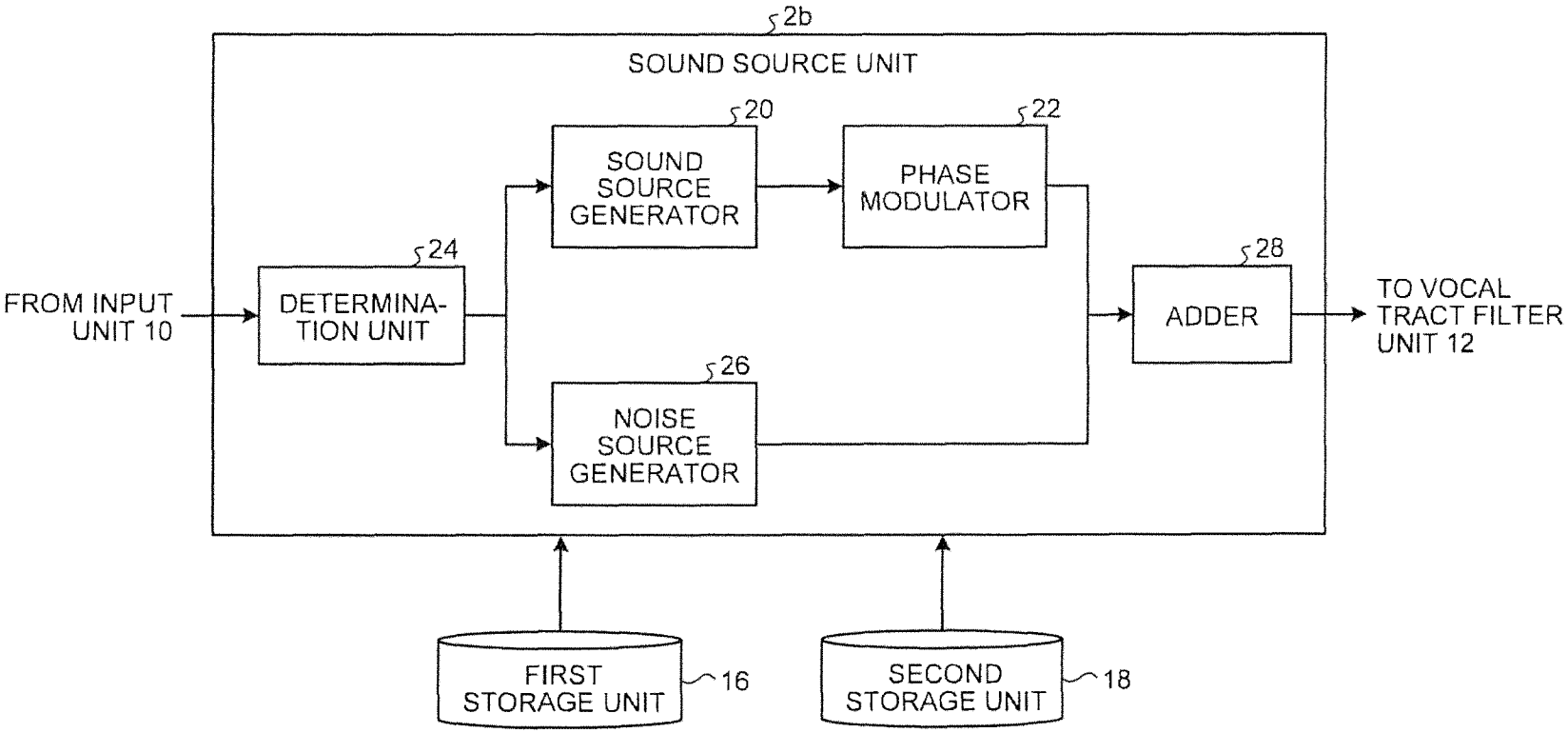
FIG. 5 is a block diagram illustrating an example of configurations of a first modification example of a sound source unit and a periphery thereof.

Next, a first modification example (sound source unit 2*b*) of the sound source unit 2*a* will be described. FIG. 5 is a block diagram illustrating an example of configurations of the first modification example (sound source unit 2*b*) of the sound source unit 2*a* and a periphery thereof. As illustrated in FIG. 5, the sound source unit 2*b* includes, for example, a determination unit 24, a sound source generator 20, a phase modulator 22, a noise source generator 26, and an adder 28. A second storage unit 18 stores a white or Gaussian noise signal used for speech synthesizing and outputs the noise signal to the sound source unit 2*b* according to an access from the sound source unit 2*b*. Note that in the sound source unit 2*b* illustrated in FIG. 5, the same sign is assigned to a part substantially identical to a part included in the sound source unit 2*a* illustrated in FIG. 2.

The determination unit 24 determines whether a frame focused by a fundamental frequency sequence included in the feature parameter received from the input unit 10 is a frame of unvoiced sound or a frame of voiced sound. Further, the determination unit 24 outputs information related to the frame of unvoiced sound to the noise source generator 26 and outputs information related to the frame of voiced sound to the sound source generator 20. For example, when a value of the frame of unvoiced sound is zero in the fundamental frequency sequence, by determining whether a value of the frame is zero, the determination unit 24 determines whether the focused frame is a frame of unvoiced sound or a frame of voiced sound.

Here, although the input unit 10 may input, into the sound source unit 2*b*, a feature parameter identical to a sequence of a feature parameter input into the sound source unit 2*a* (FIGS. 1 and 2). However, it is assumed that a feature parameter to which a sequence of a different parameter is further added is input into the sound source unit 2*b*. For example, the input unit 10 adds, to a sequence of a feature parameter, a band noise intensity sequence indicating intensity in a case of applying n (n is integer equal or larger than two) bandpass filters, which corresponds to n pass bands, to a pulse signal stored in a first storage unit 16 and a noise signal stored in the second storage unit 18.

Figure 6:
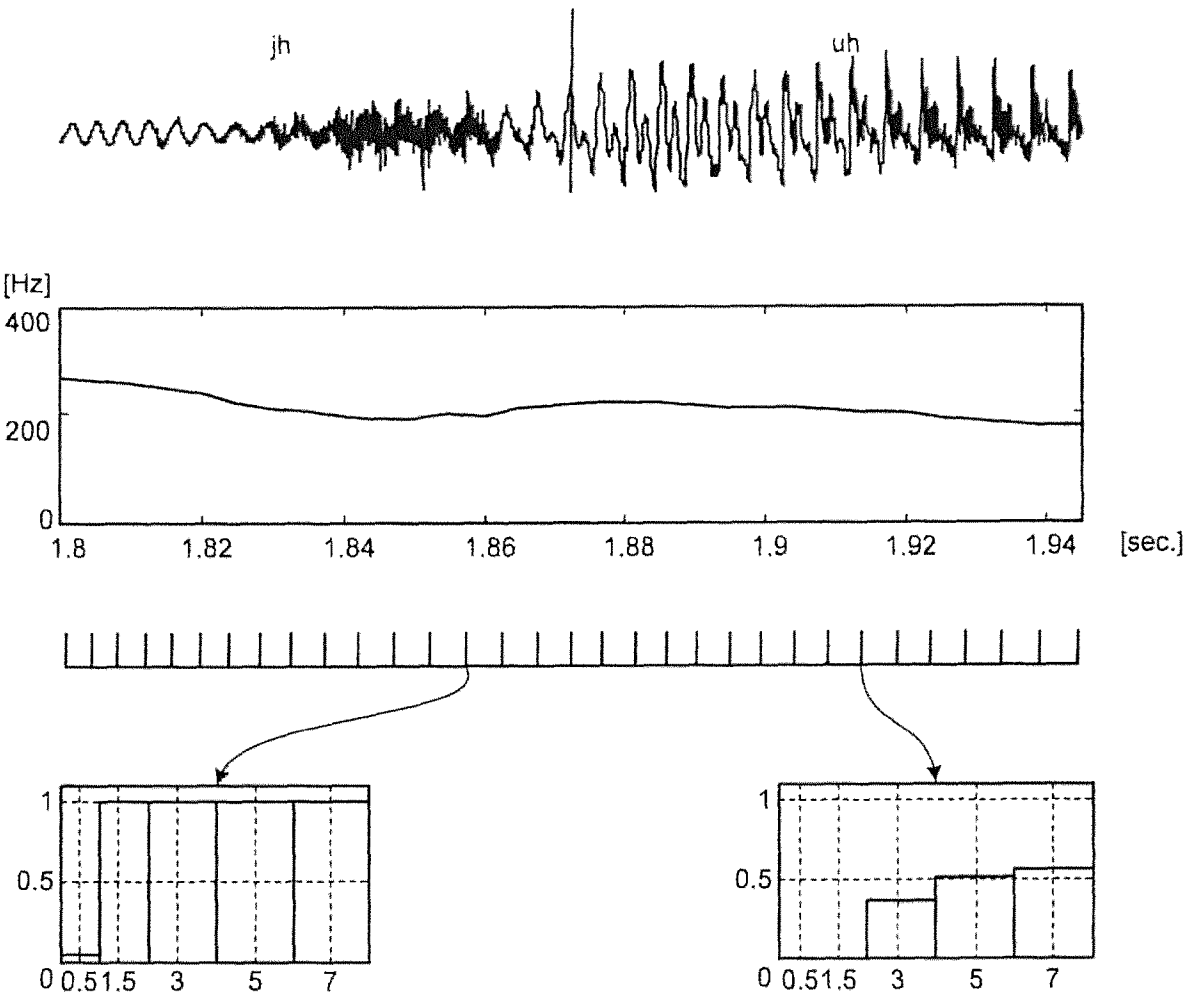
FIGS. 6A to 6D are views illustrating an example of a speech waveform, a fundamental frequency sequence, a pitch mark, and a band noise intensity sequence.

FIGS. 6A to 6D are views illustrating an example of a speech waveform, a fundamental frequency sequence, a pitch mark, and a band noise intensity sequence. FIG. 6B indicates a fundamental frequency sequence of a speech waveform illustrated in FIG. 6A. Further, band noise intensity indicated in FIG. 6D is a parameter indicating, at each pitch mark indicated in FIG. 6C, intensity of a noise component in each of bands (band 1 to band 5) divided, for example, into five by ratio with respect to a spectrum and is a value between zero and one. In the band noise intensity sequence, band noise intensity is arrayed at each pitch mark (or in each analysis frame).

All bands in the frame of unvoiced sound are assumed as noise components. Thus, a value of band noise intensity becomes one. On the other hand, band noise intensity of the frame of voiced sound becomes a value smaller than one. Generally, in a high band, a noise component becomes stronger. Further, in a high-band component of voiced fricative sound, band noise intensity becomes a value close to one. Note that the fundamental frequency sequence may be a logarithmic fundamental frequency and band noise intensity may be in a decibel unit.

Then, the sound source generator 20 of the sound source unit 2*b* sets a start point from the fundamental frequency sequence and calculates a pitch period from a fundamental frequency at a current position. Further, the sound source generator 20 creates a pitch mark by repeatedly performing processing of setting, as a next pitch mark, time in the calculated pitch period from a current position.

Further, the sound source generator 20 may generate a pulse sound source signal divided into n bands by applying n bandpass filters to a pulse signal.

Similarly to the case in the sound source unit 2*a*, the phase modulator 22 of the sound source unit 2*b* modulates only a phase of a pulse signal.

By using the white or Gaussian noise signal stored in the second storage unit 18 and the sequence of the feature parameter received from the input unit 10, the noise source generator 26 generates a noise source signal with respect to a frame including an unvoiced fundamental frequency sequence.

Further, the noise source generator 26 may generate a noise source signal to which n bandpass filters are applied and which is divided into n bands.

The adder 28 generates a mixed sound source (sound source signal to which noise source signal is added) by controlling, into a determined ratio, amplitudes of the pulse signal (phase modulation pulse train) phase-modulated by the phase modulator 22 and the noise source signal generated by the noise source generator 26 and by performing superimposition.

Further, the adder 28 may generate a mixed sound source (sound source signal to which noise source signal is added) by adjusting amplitudes of the noise source signal and the pulse sound source signal in each band according to a band noise intensity sequence and by performing superimposition.

Figure 7:
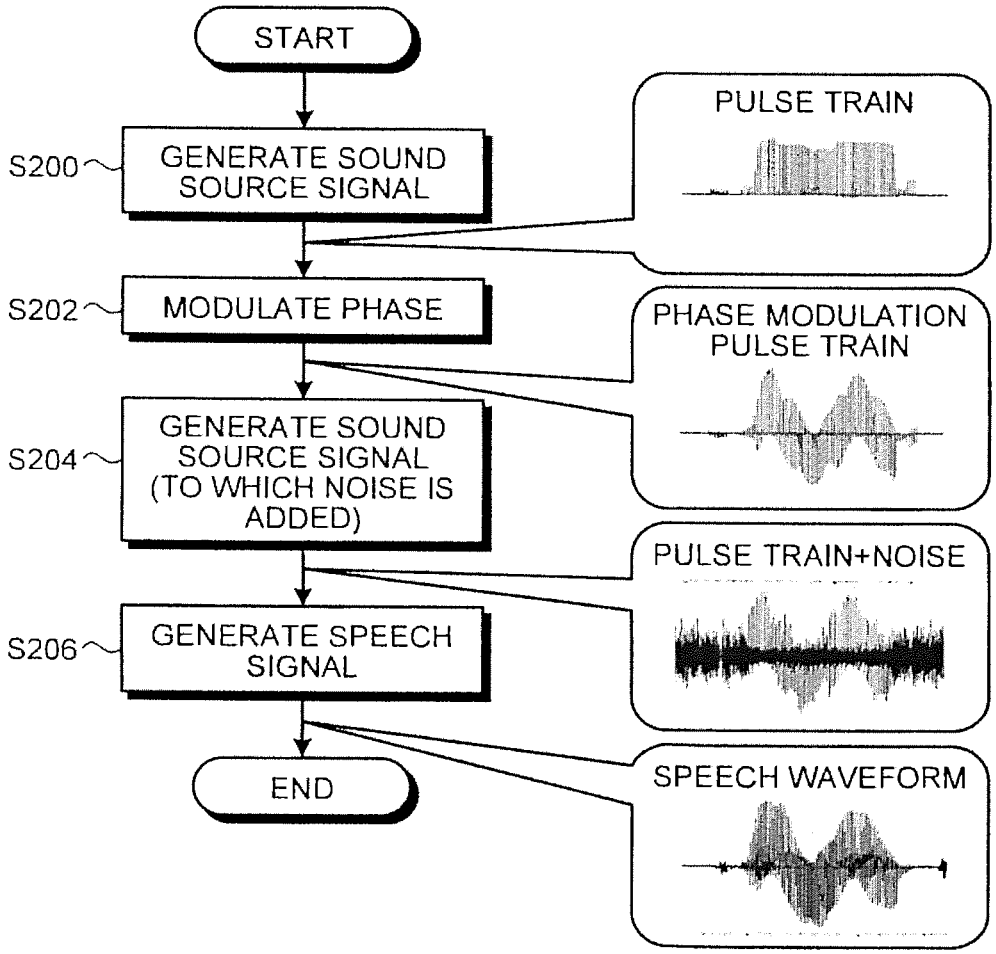
FIG. 7 is a flowchart illustrating an example of processing performed by a speech synthesizer including the sound source unit illustrated in FIG. 5.

Next, processing performed by a speech synthesizer 1 including the sound source unit 2*b* will be described. FIG. 7 is a flowchart illustrating an example of processing performed by the speech synthesizer 1 including the sound source unit 2*b* illustrated in FIG. 5. As illustrated in FIG. 7, in step S200, the sound source generator 20 generates a (pulse) sound source signal with respect to a frame of voiced sound by performing deformation of the pulse signal received from the first storage unit 16 by using a sequence of the feature parameter received from the input unit 10. That is, the sound source generator 20 outputs a pulse train.

In step S202, the phase modulator 22 performs, with respect to the sound source signal generated by the sound source generator 20, modulation of a phase of a pulse signal at each pitch mark based on a phase modulation rule using audio watermarking information included in the feature parameter. That is, the phase modulator 22 outputs a phase modulation pulse train.

In step S204, the adder 28 generates a sound source signal, to which the noise source signal (noise) is added, by controlling, into a determined ratio, amplitudes of the pulse signal (phase modulation pulse train) phase-modulated by the phase modulator 22 and the noise source signal generated by the noise source generator 26 and by performing superimposition.

In step S206, the vocal tract filter unit 12 generates a speech signal by performing a convolution operation of a sound source signal, in which a phase is modulated (noise is added) by the sound source unit 2*b*, by using a spectrum parameter sequence which is received through the sound source unit 2*b*. That is, the vocal tract filter unit 12 outputs a speech waveform.

Second Modification Example of Sound Source Unit 2*a*: Sound Source Unit 2*c*

Figure 8:
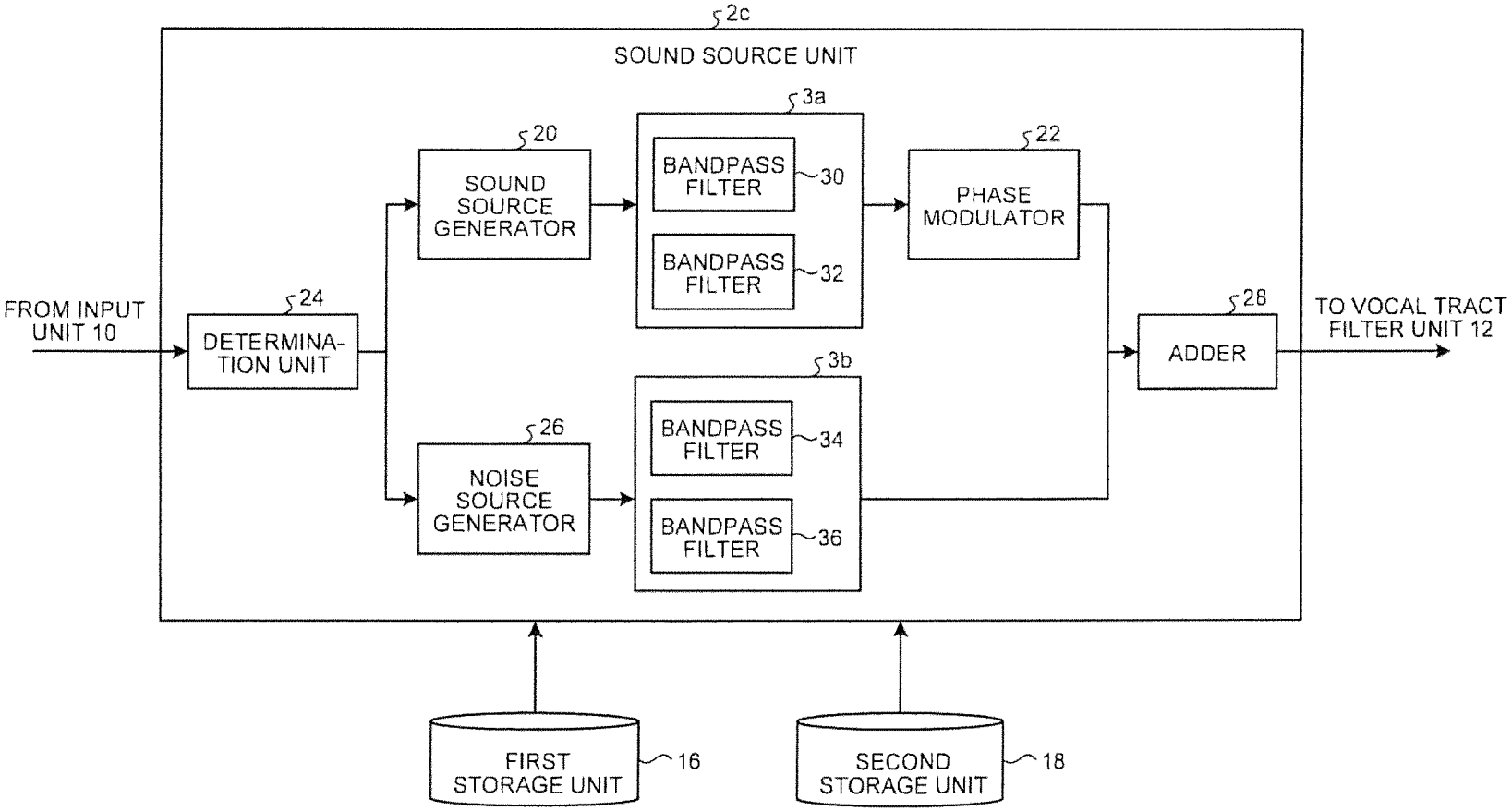
FIG. 8 is a block diagram illustrating an example of configurations of a second modification example of the sound source unit and a periphery thereof.

Next, a second modification example (sound source unit 2*c*) of the sound source unit 2*a* will be described. FIG. 8 is a block diagram illustrating an example of configurations of the second modification example (sound source unit 2*c*) of the sound source unit 2*a* and a periphery thereof. As illustrated in FIG. 8, the sound source unit 2*c* includes, for example, a determination unit 24, a sound source generator 20, a filter unit 3*a*, a phase modulator 22, a noise source generator 26, a filter unit 3*b*, and an adder 28. Note that in the sound source unit 2*c* illustrated in FIG. 8, the same sign is assigned to a part substantially identical to a part included in the sound source unit 2*b* illustrated in FIG. 5.

The filter unit 3*a* includes bandpass filters 30 and 32 which pass signals in different bands and control a band and intensity. For example, the filter unit 3*a* generates a sound source signal divided into two bands by applying the two bandpass filters 30 and 32 to a pulse signal of a sound source signal generated by the sound source generator 20. Further, the filter unit 3*b* includes bandpass filters 34 and 36 which pass signals in different bands and control a band and intensity. For example, the filter unit 3*b* generates a noise source signal divided into two bands by applying the two bandpass filters 34 and 36 to a noise source signal generated by the noise source generator 26. Accordingly, in the sound source unit 2*c*, the filter unit 3*a* is provided separately from the sound source generator 20 and the filter unit 3*b* is provided separately from the noise source generator 26.

Further, the adder 28 of the sound source unit 2*c* generates a mixed sound source (sound source signal to which noise source signal is added) by adjusting amplitudes of the noise source signal and the pulse sound source signal in each band according to a band noise intensity sequence and by performing superimposition.

Note that each of the above-described sound source unit 2*b* and sound source unit 2*c* may include a hardware circuit or software executed by a CPU. The second storage unit 18 includes, for example, an HDD or a memory. Further, software (program) executed by the CPU may be distributed by being stored in a recording medium such as a magnetic disk, an optical disk, or a semiconductor memory or distributed through a network.

In such a manner, in the speech synthesizer 1, the phase modulator 22 modulates only a phase of a pulse signal, that is, a voiced part based on audio watermarking information. Thus, it is possible to insert an audio watermarking without deteriorating quality of a synthesized speech.

Audio Watermarking Information Detection Apparatus

Figure 9:
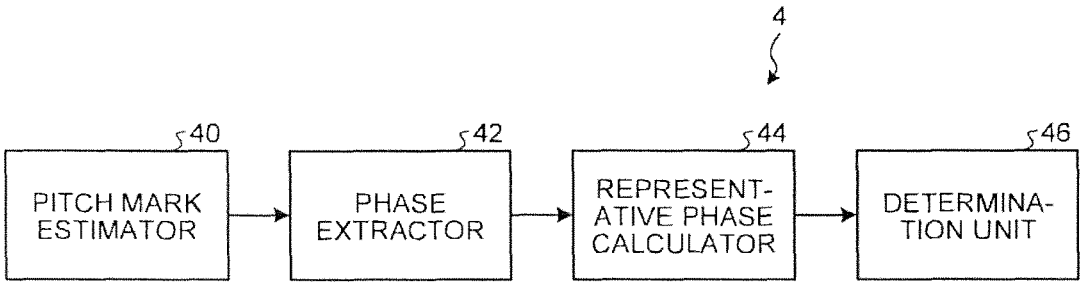
FIG. 9 is a block diagram illustrating an example of a configuration of an audio watermarking information detection apparatus according to an embodiment.

Next, an audio watermarking information detection apparatus to detect audio watermarking information from a synthesized speech into which an audio watermarking is inserted will be described. FIG. 9 is a block diagram illustrating an example of a configuration of the audio watermarking information detection apparatus 4 according to the embodiment. Note that the audio watermarking information detection apparatus 4 is realized, for example, by a general computer. That is the audio watermarking information detection apparatus 4 includes, for example, a function as a computer including a CPU, a storage apparatus, an input/output apparatus, and a communication interface.

As illustrated in FIG. 9, the audio watermarking information detection apparatus 4 includes a pitch mark estimator 40, a phase extractor 42, a representative phase calculator 44, and a determination unit 46. Each of the pitch mark estimator 40, the phase extractor 42, the representative phase calculator 44, and the determination unit 46 may include a hardware circuit or software executed by a CPU. That is, a function of the audio watermarking information detection apparatus 4 may be realized by execution of an audio watermarking information detection program.

The pitch mark estimator 40 estimates a pitch mark sequence of an input speech signal. More specifically, the pitch mark estimator 40 estimates a sequence of a pitch mark by estimating a periodic pulse from an input signal or a residual signal (estimated sound source signal) of the input signal, for example, by an LPC analysis and outputs the estimated sequence of the pitch mark to the phase extractor 42. That is, the pitch mark estimator 40 performs residual signal extraction (speech extraction).

For example, at each estimated pitch mark, the phase extractor 42 extracts, as a window length, a width which is twice as wide as a shorter one of longitudinal pitch widths and extracts a phase at each pitch mark in each frequency bin. The phase extractor 42 outputs a sequence of the extracted phase to the representative phase calculator 44.

Based on the above-described phase modulation rule, the representative phase calculator 44 calculates a representative phase to be a representative of a plurality of frequency bins or the like from the phase extracted by the phase extractor 42 and outputs a sequence of the representative phase to the determination unit 46.

Based on the representative phase value calculated at each pitch mark, the determination unit 46 determines whether there is audio watermarking information. Processing performed by the determination unit 46 will be described in detail with reference to FIGS. 10A and 10B.

Figure 10A:
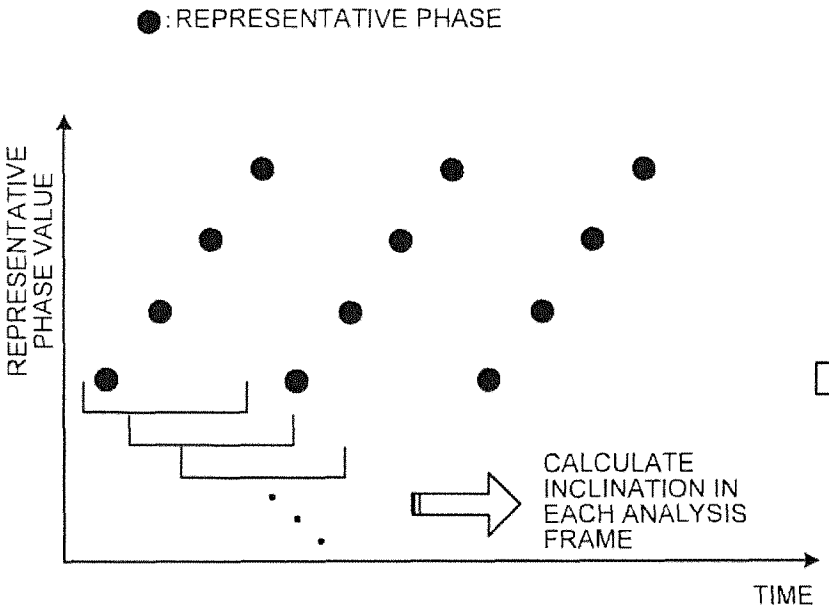
FIGS. 10A and 10B are graphs illustrating processing performed by a determination unit in a case of determining whether there is audio watermarking information based on a representative phase value.
Figure 10B:
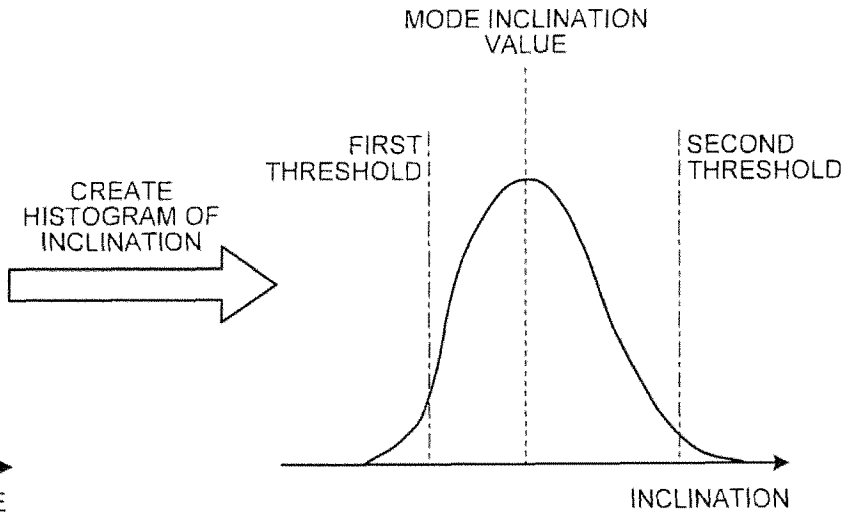

FIGS. 10A and 10B are graphs illustrating processing performed by the determination unit 46 in a case of determining whether there is audio watermarking information based on a representative phase value. FIG. 10A is a graph indicating a representative phase value at each pitch mark which value varies as time elapses. The determination unit 46 calculates an inclination of a straight line formed by a representative phase in each analysis frame (frame) which is a predetermined period in FIG. 10A. In FIG. 10A, frequency intensity a appears as an inclination of a straight line.

Then, the determination unit 46 determines whether there is audio watermarking information according to the inclination. More specifically, the determination unit 46 first creates a histogram of an inclination and sets the most frequent inclination as a representative inclination (mode inclination value). Next, as illustrated in FIG. 10B, the determination unit 46 determines whether the mode inclination value is between a first threshold and a second threshold. When the mode inclination value is between the first threshold and the second threshold, the determination unit 46 determines that there is audio watermarking information. Further, when the mode inclination value is not between the first threshold and the second threshold, the determination unit 46 determines that there is not audio watermarking information.

Figure 11:
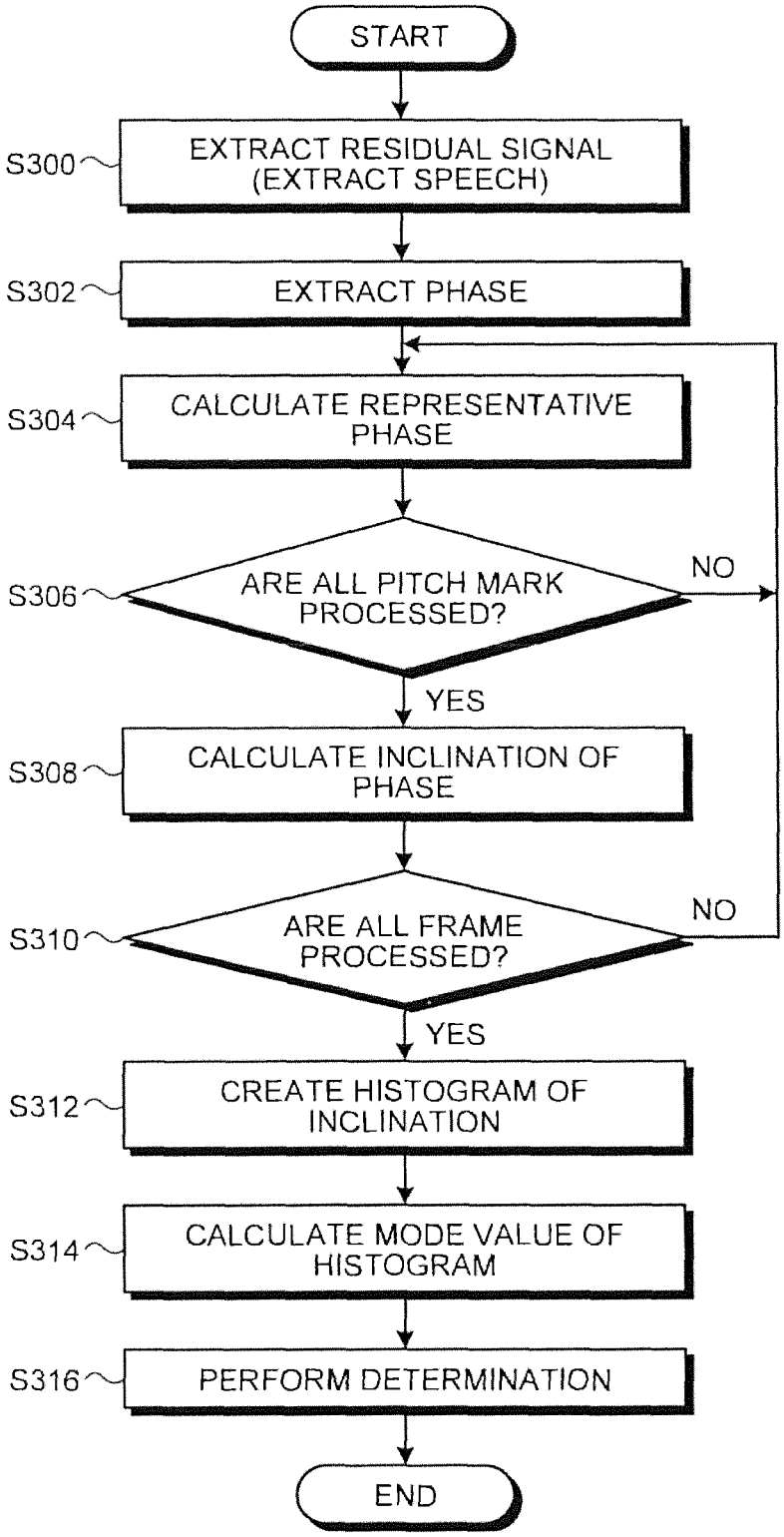
FIG. 11 is a flowchart illustrating an example of an operation of the audio watermarking information detection apparatus according to the embodiment.

Next, an operation of the audio watermarking information detection apparatus 4 will be described. FIG. 11 is a flowchart illustrating an example of an operation of the audio watermarking information detection apparatus 4. As illustrated in FIG. 11, in step S300, the pitch mark estimator 40 performs residual signal extraction (speech extraction).

In step S302, at each pitch mark, the phase extractor 42 performs extraction, as a window length, a width which is twice as wide as a shorter one of longitudinal pitch widths and extracts a phase.

In step S304, based on a phase modulation rule, the representative phase calculator 44 calculates a representative phase to be a representative of a plurality of frequency bins from the phase extracted by the phase extractor 42.

In step S306, the CPU determines whether all pitch marks in a frame are processed. When determining that all pitch marks in the frame are processed (S306: Yes), the CPU goes to processing in S308. When determining that not all of the pitch marks in the frame are processed (S306: No), the CPU goes to processing in S302.

In step S308, the determination unit 46 calculates an inclination of a straight line (inclination of representative phase) which is formed by a representative phase in each frame.

In step 310, the CPU determines whether all frames are processed. When determining that all frames are processed (S310: Yes), the CPU goes to processing in S312. Further, when determining that not all of the frames are processed (S310: No), the CPU goes to processing in S302.

In step S312, the determination unit 46 creates a histogram of the inclination calculated in the processing in S308.

In step S314, the determination unit 46 calculates a mode value (mode inclination value) of the histogram created in the processing in S312.

In step S316, based on the mode inclination value calculated in the processing in S314, the determination unit 46 determines whether there is audio watermarking information.

In such a manner, the audio watermarking information detection apparatus 4 extracts a phase at each pitch mark and determines whether there is audio watermarking information based on a frequency of an inclination of a straight line formed by a representative phase. Note that the determination unit 46 does not necessarily determine whether there is audio watermarking information by performing the processing illustrated in FIGS. 10A and 10B and may determine whether there is audio watermarking information by performing different processing.

Example of Different Processing Performed by Determination Unit 46

Figure 12A:
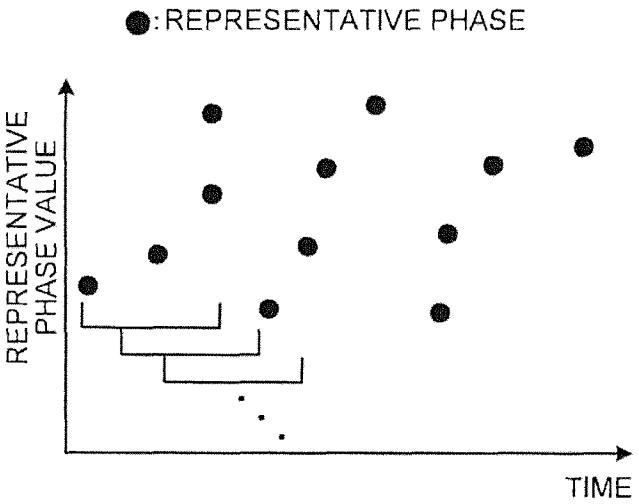
FIGS. 12A to 12C are graphs illustrating a first example of different processing performed by the determination unit in a case of determining whether there is audio watermarking information based on a representative phase value.
Figure 12B:
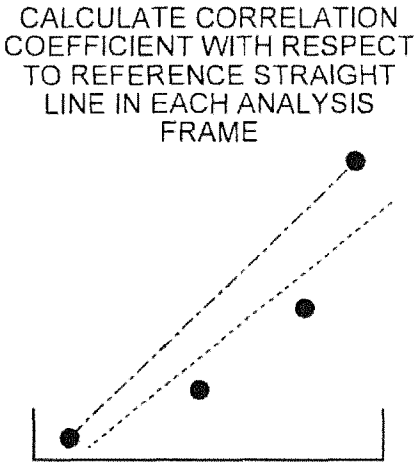
Figure 12C:
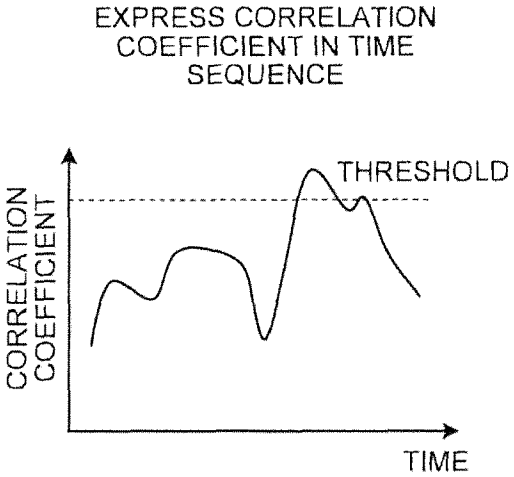

FIGS. 12A to 12C are graphs illustrating a first example of different processing performed by the determination unit 46 in a case of determining whether there is audio watermarking information based on a representative phase value. FIG. 12A is a graph indicating a representative phase value at each pitch mark which value varies as time elapses. In FIG. 12B, a dashed-dotted line indicates a reference straight line assumed as an ideal value of a variation of a representative phase in elapse of time in an analysis frame (frame) which is a predetermined period. Further, in FIG. 12B, a broken line is an estimation straight line indicating an inclination estimated from each of representative phase values (such as four representative phase value) in an analysis frame.

The determination unit 46 calculates a correlation coefficient with respect to a representative phase by shifting the reference straight line longitudinally in each analysis frame. As illustrated in FIG. 12C, when a frequency of a correlation coefficient in an analysis frame exceeds a predetermined threshold in a histogram, it is determined that there is audio watermarking information. Further, when a frequency of the correlation coefficient in the analysis frame does not exceed the threshold in the histogram, the determination unit 46 determines that there is not audio watermarking information.

Figure 13:
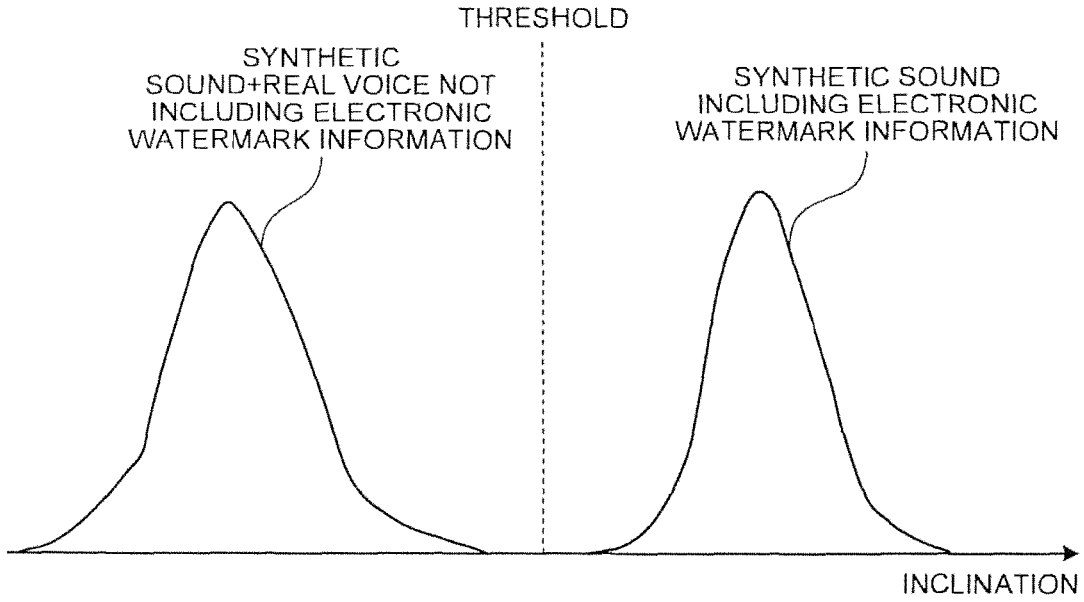
FIG. 13 is a view illustrating a second example of different processing performed by the determination unit in a case of determining whether there is audio watermarking information based on a representative phase value.

FIG. 13 is a view illustrating a second example of different processing performed by the determination unit 46 in a case of determining whether there is audio watermarking information based on a representative phase value. The determination unit 46 may determine whether there is audio watermarking information by using a threshold indicated in FIG. 13. Note that the threshold indicated in FIG. 13 creates a histogram of an inclination of a straight line formed by a representative phase with respect to synthetic sound including audio watermarking information and synthetic sound (or real voice) not including audio watermarking information and sets the two histograms as points which can be the most separated.

Further, the determination unit 46 may learn a model statistically with an inclination of a straight line, which is formed by a representative phase of synthetic sound including audio watermarking information, as a feature amount and may determine whether there is audio watermarking information with likelihood as a threshold. Further, the determination unit 46 may learn a model statistically with an inclination of a straight line, which is formed by a representative phase of each of synthetic sound including audio watermarking information and synthetic sound not including audio watermarking information, as a feature amount. Then, the determination unit 46 may determine whether there is audio watermarking information by comparing likelihood values.

A program executed in each of the speech synthesizer 1 and the audio watermarking information detection apparatus 4 of the present embodiment is provided by being recorded, as a file in a format which can be installed or executed, in a computer-readable recording medium such as a CD-ROM, a flexible disk (FD), a CD-R, or a digital versatile disk (DVD).

Further, each program of the present embodiment may be stored in a computer connected to a network such as the Internet and may be provided by being downloaded through the network.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An audio watermarking information detection apparatus comprising:

a memory; and one or more processors configured to function as a pitch mark estimator, a phase extractor, a representative phase calculator and a determination unit, wherein the pitch mark estimator estimates a pitch mark of a synthesized speech in which audio watermarking information is embedded and extracts a speech at each estimated pitch mark;

the phase extractor extracts a phase of the speech extracted by the pitch mark estimator;

the representative phase calculator calculates a representative phase to be a representative of a plurality of frequency bins from the phase extracted by the phase extractor; and the determination unit determines, based on the representative phase, whether the audio watermarking information exists in the synthesized speech.

2. The audio watermarking information detection apparatus according to claim 1, wherein the determination unit calculates, in each frame which is a predetermined period, an inclination indicating a variation of the representative phase in elapse of time, and determines, based on a frequency of the inclination, whether there is the audio watermarking information.

3. The audio watermarking information detection apparatus according to claim 1, wherein the determination unit calculates, in each frame which is a predetermined period, a correlation coefficient between the representative phase and a reference straight line which is assumed as an ideal value of a variation of the representative phase in elapse of time, and determines that there is the audio watermarking information when the correlation coefficient exceeds a predetermined threshold.

4. An audio watermarking information detection method employed for an audio watermarking information detection apparatus including a memory and one or more processors configured to function as a pitch mark estimator, a phase extractor, a representative phase calculator and a determination unit, comprising:

estimating, by the itch mark estimator, a pitch mark of a synthesized speech in which audio watermarking information is embedded and extracting a speech at each estimated pitch mark;

extracting, by the phase extractor, a phase of the extracted speech;

calculating, by representative phase calculator, from the extracted phase, a representative phase to be a representative of a plurality of frequency bins; and determining, by the determination unit, based on the representative phase, whether the audio watermarking information exists in the synthesized speech.

5. A computer program product comprising a non-transitory computer-readable medium that includes an audio watermarking information detection program to cause a computer to execute:

estimating a pitch mark of a synthesized speech in which audio watermarking information is embedded and extracting a speech at each estimated pitch mark, extracting a phase of the extracted speech, calculating, from the extracted phase, a representative phase to be a representative of a plurality of frequency bins, and determining, based on the representative phase, whether the audio watermarking information exists in the synthesized speech.

* * * * *